United States Patent [19]

Endo

[11] Patent Number: 4,622,486

[45] Date of Patent: Nov. 11, 1986

[54] HALOGEN LAMP DEVICE FOR HEADLAMP

[75] Inventor: Ariyoshi Endo, Atsugi, Japan

[73] Assignee: Ichikoh Industries, Limited, Tokyo, Japan

[21] Appl. No.: 666,454

[22] Filed: Oct. 30, 1984

[30] Foreign Application Priority Data

Oct. 31, 1983 [JP] Japan ..... 58-202796
May 31, 1984 [JP] Japan ..... 59-109440

[51] Int. Cl.[4] ..... H01K 1/28; H01K 1/42

[52] U.S. Cl. ..... 313/115; 313/579; 313/318

[58] Field of Search ..... 313/113, 115, 579, 318

[56] References Cited

U.S. PATENT DOCUMENTS 4,463,278 7/1984 Kosmatka et al. ..... 313/318
4,500,946 2/1985 Mikola ..... 362/226
4,528,619 7/1985 Dolan et al. ..... 313/113 X
4,547,838 10/1985 Wakimizu ..... 313/318 X

*Primary Examiner*—Palmer C. DeMeo
*Attorney, Agent, or Firm*—Schwartz, Jeffery, Schwaab, Mack, Blumenthal & Evans

[57] ABSTRACT

The present invention relates to a halogen lamp device for a headlamp. The halogen lamp device for the headlamp has an airtightly sealed lamp enclosure including a light beam passing lens, a reflector for guiding the light beam and a socket opening provided in the reflector, and a holder in which a halogen lamp having filaments inserted through the socket opening of the lamp enclosure and sealed is mounted, and comprises a metallic sleeve member engaged with the holder, and a metallic bulb support formed to have a supporting portion for supporting the halogen bulb in engagement with the outer peripheral surface of a pinch-seal portion of the halogen bulb and a base including a flange fastened to the sleeve member, the bulb support being formed to enable to adjust the halogen bulb at a prepositioned position in the lamp enclosure and fastened to the sleeve member after the adjusting.

7 Claims, 9 Drawing Figures

HALOGEN LAMP DEVICE FOR HEADLAMP

BACKGROUND OF THE INVENTION (a) Field of the Invention

The present invention relates to a halogen lamp assembly detachably inserted into a reflector housing or enclosure having a lens and a reflector and, more particularly, to a mounting structure of a halogen bulb in a holder.

(b) Description of the Prior Art

In a halogen lamp device for an automotive headlamp, a halogen lamp is inserted into a reflector housing having a cover lens and a reflector in a state to be fastened to a holder so that the filament of the lamp is disposed at an adequate position in the reflector enclosure. The lead wires of the filament to be removed from a pinch-seal portion of the halogen lamp are welded to a support mounted in the holder and the support is electrically connected to an external connector. In other words, a bulb body is held by the support at a predetermined position with respect to the holder. A mounting structure of such a bulb holder is disclosed in Japanese unexamined patent publication No. 58-123653 laid-opened on July 22, 1983, corresponding to U.S. patent application Ser. No. 339,194 filed on Jan. 13, 1982. However, since the bulb body is held directly to the support, a large load is applied to the welding portions of the lead wires of the filament to the support when an external force is applied to the bulb during handling or assembling work. Since the lead wires of the filament are formed of a material softer than that of the support, the lead wires themselves are deformed in the vicinity of the welded portions, and the relative position of the filament to the holder might be varied. This means that the filament cannot be disposed at the position where the halogen lamp assembly is mounted on the reflector, thereby resulting in a disadvantage in the distribution of a light beam emitted from the headlamp.

SUMMARY OF THE INVENTION

It is, therefore, an object of the present invention to provide a halogen lamp device for an automotive headlamp having a rigid mounting structure of a halogen bulb.

Another object of the present invention is to provide a halogen lamp device having a halogen bulb mounting structure capable of readily adjusting the filaments of the halogen bulb to a suitable position.

The above and other objects of the invention will be apparent by those skilled in the art from a reading of the following detailed description of the disclosure found in the accompanying drawings and novelty thereof pointed out in the appended claims.

DETAILED DESCRIPTION OF THE PREFERRED EMBODIMENTS

Embodiments of the present invention will now be described in more detail with reference to the accompanying drawings.

Figure 1:
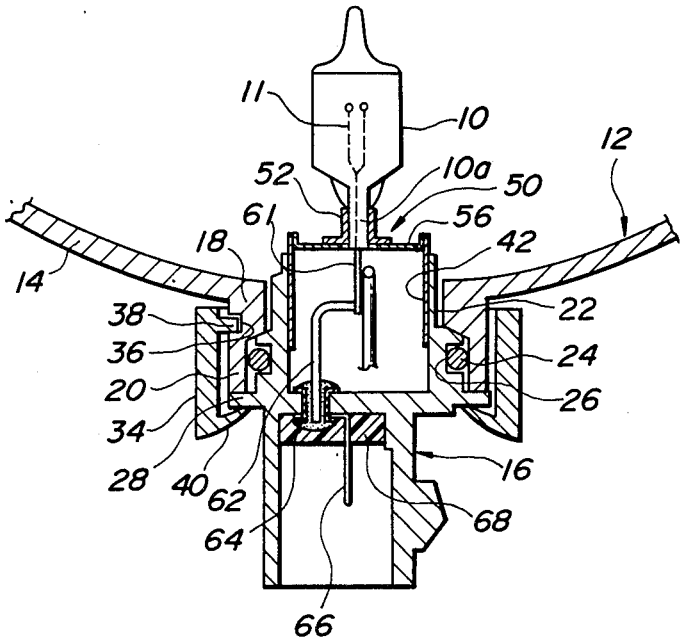
FIG. 1 is a partial sectional view showing an embodiment of a halogen lamp device for a headlamp according to the present invention.

In FIG. 1, reference numeral 10 designates a halogen bulb for a headlamp, which bulb has filaments 11 therein. The halogen bulb 10 is mounted to be disposed at a predetermined position in a reflector housing or enclosure 12. The reflector housing is partially shown, and has a lens portion (not shown) and a reflector 14 fastened to the lens portion in a sealed state to the lens portion. A holder 16 for mounting the bulb 10 of a halogen bulb lamp assembly according to the present invention is inserted into and sealed at the reflector enclosure 12 from an opening 22 formed at the bottom of the reflector 14. In other words, a socket 18 is formed of an annular wall 20 extended from the bottom of the reflector 14 toward the outside and the opening 22 for the holder 16 of the halogen bulb lamp assembly. The holder 16 is inserted from the outside into the opening 22 of the socket, and airtightly sealed at the inner surface of the annular wall 20 of the socket through an annular elastic O-ring 24. The O-ring 24 is arranged in an annular groove 26 formed on the outer peripheral surface of the holder 16. The annular wall 20 of the reflector 14 is formed to be contacted at the part of the inner surface thereof with the O-ring 24 and contacted at the lower end thereof with the upper surface of a flange 28 projected from the holder 16 toward the outside. The projecting portion 32 of the holder 16 is engaged with an oblique wall 30 formed on the inner surface of the socket 18 in the state that the holder 16 is inserted into the socket 18, thereby limiting the distance that the holder 16 is inserted into the socket 18. An annular holding member 34 is arranged around the holder 16 and the annular wall 20 of the socket in this state. Three projecting portions 38 (only one of which is shown) are formed on the top of the holding member 34 at an equal interval in a circumferential direction, and formed to be respectively engaged with three grooves 36 (one of which is shown) formed on the outer peripheral surface of the annular wall 20. A table 40 which makes contact with the lower surface of the flange 28 of the holder 17 is formed on the lower portion of the holding member 34. The elastic O-ring 24 is snugly contacted with the outer peripheral surface of the holder 16 and the inner peripheral surface of the annular wall 20 in the state that the holder 16 and the annular wall 20 of the socket are held by the holding member 34, thereby holding an airtight seal between the holder 16 and the socket 18.

Figure 2:
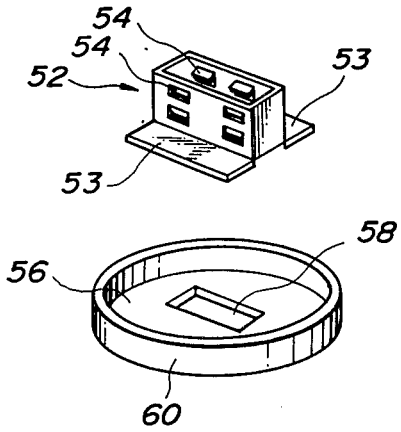
FIG. 2 is an enlarged exploded perspective view showing a supporting portion and a flange of a bulb support.

The holder 16 is formed of synthetic resin in a cylindrical shape, and a sleeve member 42 of cylindrical metal material is press-fitted from the upper opening of the holder 16. A bulb support 50 for mounting the halogen bulb 10 is fastened to the sleeve member 42. The bulb support 50 is formed of a metal material and composed of a supporting portion 52 formed in response to the shape of the outer peripheral surface of the pinch-seal portion 10*a* of the bulb 10 and a mounting base 56 for connecting the supporting portion 52 to the sleeve member 42. The support 50 shown in FIG. 2 is composed to support the halogen bulb 10 having the pinch-seal portion of substantially rectangular cross section. The supporting portion 52 is constructed substantially in a rectangular section for engaging the outer peripheral surface of the pinch-seal portion. This supporting portion 52 has anchoring pieces 54 projected obliquely downwardly therein at part of the opposite side walls thereof. The anchoring pieces 54 are formed to respectively make contact with the opposite side walls of the pinch-seal portion 10*a* when the pinch-seal portion 10*a* is inserted into an inserting passage surrounded by the wall of the supporting portion 52. The supporting portion 52 may be preferably formed of a metal material having suitable elastic recoiling force when the projected anchoring pieces 54 are contacted with the pinch-seal portion 10*a*. In this state, the opposite side walls of the pinch-seal portion 10*a* are held by the elastic recoiling forces of opposite directions of the anchoring pieces 54 contacted with the side walls of the pinch-seal portion 10*a*. The lower ends of the opposite side walls of the supporting portion 52 are extended oppositely to form wings 53.

A mounting base 56 as another element of the bulb support 50 is formed to be substantially equal to or slightly smaller than the bore of the sleeve member 42 in the outer diameter of the sleeve member 42 to be engaged with the sleeve member 42. The base 56 is formed of a metal material similar to the supporting portion 52, has an opening 58 substantially at the center thereof, and a flange 60 extending at the peripheral edge thereof in a vertical direction. The supporting portion 52 is mounted by welding to the base 56 in the state that the above-described pinch-seal portion inserting passage is aligned substantially with the opening 58. The opening 58 is formed in size sufficient to guide the pinch-seal portion or lead wires 61. The supporting portion 52 and the mounting base 56 are separately constructed, and composed to be useful for the positioning operation for disposing the filaments of the bulb 10 at a suitable position in the reflector enclosure after the bulb 10 is fastened to the supporting portion 52. The flange 60 of the base 56 is engaged within the sleeve member 42, and welded fixedly to the sleeve member 42.

Figure 3:
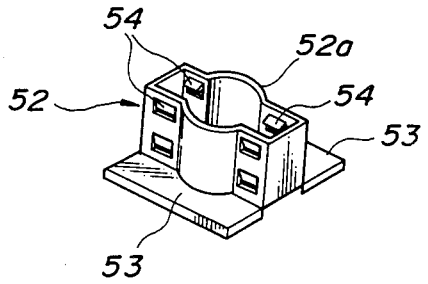
FIG. 3 is an enlarged perspective view showing other example of the supporting portion.

FIG. 3 shows a modified example of the supporting portion 52.

This supporting portion 52 is formed with a spherical wall 52*a* for engaging the spherical portion formed on the pinch-seal portion 10*a* of the halogen bulb 10, when the pinch-seal portion 10*a* is formed to have the spherical portion. Thus, the supporting portion 52 is formed to have an engating wall formed in response to the shape of the outer peripheral surface of the pinch-seal portion 10*a* of the bulb 10 and to also have an anchoring piece 54 for snugly holding the pinch-seal portion 10*a* of the bulb 10.

Figure 4:
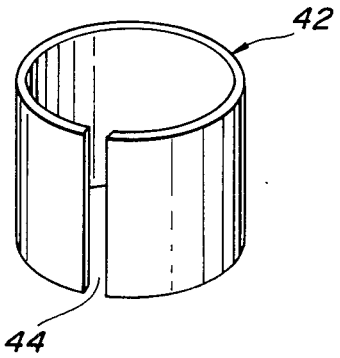
FIG. 4 is an enlarged perspective view showing another example of a sleeve member.
Figure 5:
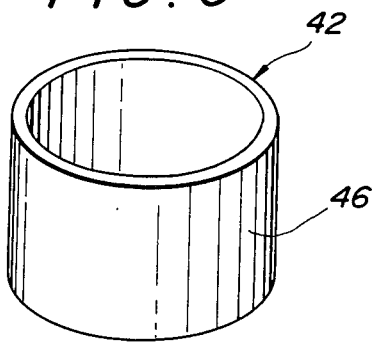
FIG. 5 is an enlarged perspective view showing still another example of the sleeve member.

The above-described sleeve member 42 may be preferably formed to have a slit 44 axially at part of the cylindrical shape as shown in FIG. 4. Thus, the sleeve member 42 can be prevented from deforming due to the press-fitting of the sleeve member 42 into the opening of the holder 16 when press-fitting the sleeve member 42 into the opening of the holder 16. As shown in FIG. 5, when the sleeve member 42 is formed to have a tapered surface 46 reduced in diameter with respect to the press-fitting direction, the sleeve member 42 may be readily press-fitted into the holder 16.

In the halogen lamp device according to the present invention, the lead wires 61 of the halogen bulb 10 fastened to the bulb support 50 are guided into the holder 16 through the opening 58 from the lower end of the pinch-seal portion 10*a*, and welded to a support 62. The support 62 is movably engaged with a metallic cylinder 64 to be engaged with the inner wall of a mounting hole 64 formed in the holder 16 and soldered thereto. A blade terminal 66 which is connected to an external connector (not shown) is fastened to the cylinder 64. Since the mounting hole 64 is formed to communicate with the interior of the reflector enclosure 12, solidified synthetic resin sealing cement 68 is buried between the inner walls of the holder 16 in the vicinity of the outlet of the mounting hole 64.

The operation for fastening the halogen bulb 10 to the holder 16 is carried out in order as below. The sleeve member 42 is first press-fitted from the upper opening of the holder 16, and the sleeve member 52 is fastened to the holder 16. Or, the sleeve member 42 is heated by high frequency heating, and the heated sleeve member 42 is inserted into the synthetic resin holder 16. The holder 16 is fused at the contacting portion thereof by means of the heat of the sleeve member 42, the sleeve member 42 is smoothly inserted into the holder 16, and the both members are then snugly fitted. The pinch-seal portion 10*a* of the bulb 10 is engaged with the supporting portion 52 of the bulb support 50, and the pinch-seal portion 10*a* is tightly fastened by the anchoring pieces 54 of the supporting portion 52. The lead wires 61 of the filaments are guided out from the opening 58 of the base 56, and welded in advance by spot welding to the support 62. Further, the support 62 is disposed in such a manner that the support 52 is not fastened to the base 56, the base 56 is engaged with the sleeve member 42, and the lower end of the support 62 is inserted into the cylinder 64. At this time, the flange 60 of the base 56 is moved along the inner wall of the sleeve member 42, and the filaments are positioned in the vertical direction. When the supporting portion 52 is being moved on the base 56, the filament are positioned in a lateral direction. The filaments can be disposed at an adequate position in the reflector enclosure 12 by means of these series of positioning operations, the base 56 is then welded to the sleeve member 42, and the wings 53 of the supporting portion 52 are welded to the base 56. After the filaments are positioned as described above, the support 62 spot welded to the lead wires 61 is soldered to the metallic cylinder 64. The synthetic resin 68 fused from the side that the blade terminal 66 is mounted is eventually flowed between the inner walls of the holder 16, thereby sealing therebetween.

Since the mounting structure of the halogen bulb according to the present invention is thus constructed such that the halogen bulb 10 is disposed on the mounting base 56 in the state that the bulb 10 is engaged with the supporting portion 52 of the support 50, the base 56 is elevationally moved with respect to the sleeve 42, the supporting portion 52 is further moved freely on the base 56 to position and adjust the filaments and the movable portion is welded after the positioning, the halogen bulb 10 can be snugly fastened accurately to the predetermined position in the reflector enclosure. Since the pinch-seal portion 10*a* is tightly held by the supporting portion 52 after the assembling even if the halogen bulb is collided when the halogen bulb 10 is assembled with the reflector 14, the bulb 10 may not displace from the prepositioned position.

FIGS. 6 through 9 show still another embodiment of the halogen lamp device according to the present invention, wherein the same reference numerals as in the first embodiment denote the same or equivalent parts in this embodiment.

Figure 6:
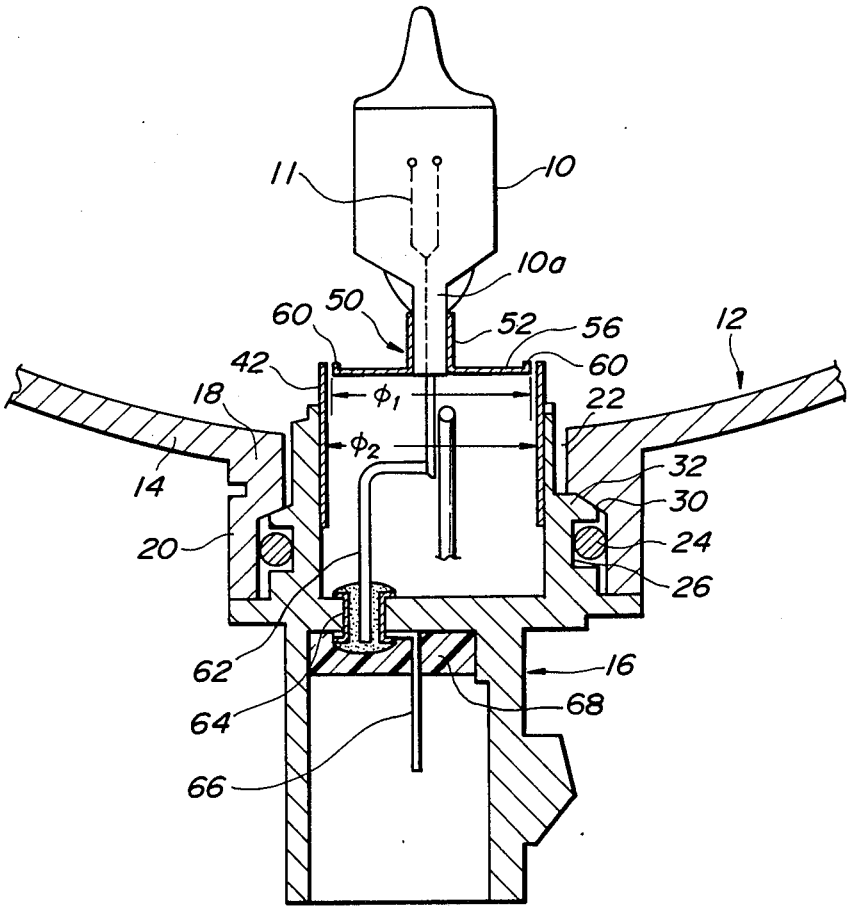
FIG. 6 is a partial sectional view showing an essential portion in another embodiment of the present invention.
Figure 7:
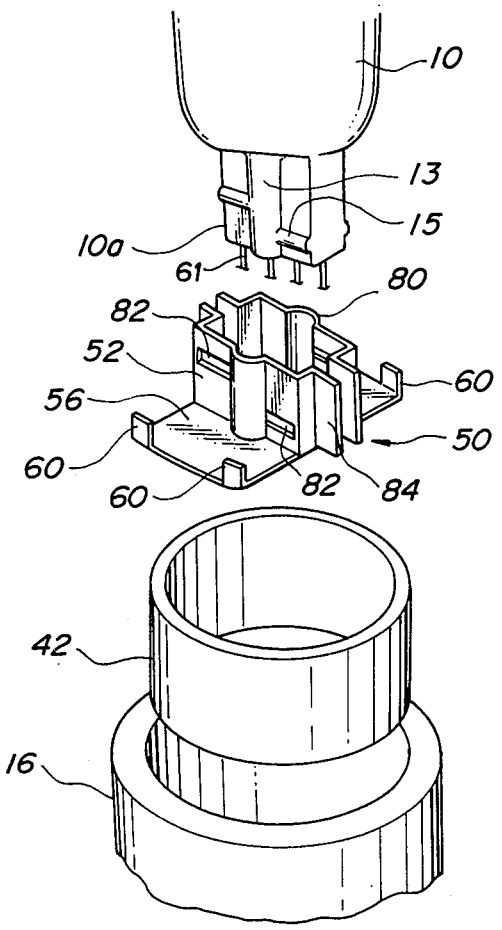
FIG. 7 is an enlarged exploded perspective view showing the essential portion.
Figure 8:
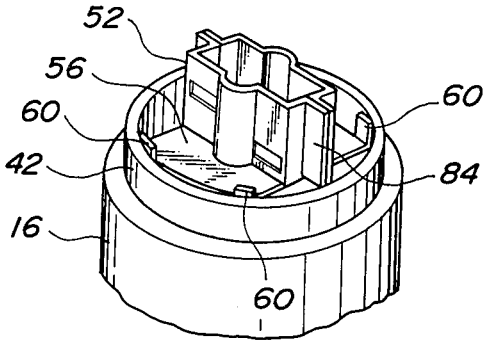
FIG. 8 is an enlarged perspective view showing a mounting state of a bulb support and a sleeve member in such a manner that the bulb is omitted.

In FIG. 6, the holding member 34 which has been described with respect to the first embodiment will be omitted for the convenience of simplicity.

In this embodiment, a supporting portion 52 for supporting the pinch-seal portion 10*a* of the halogen bulb 10 is formed integrally with a mounting base 56. In other words, a bulb support 50 is constructed to fasten the pinch-seal portion 10*a* by a pair of supporting portions 52 formed in a split manner by pressing a metal plate. The pinch-seal portion 10*a* is formed to have a spherical surface 13 and a horizonally projecting portion 15 on the opposite side surfaces thereof. A recess 80 to be contacted with the spherical surface 13 and a groove 82 to be engaged with the spherical surface 15 are respectively formed on the opposite side walls of the supporting portions 52. The bases 56 extending horizontally from the lower ends of the side walls of the supporting portions 52 are respectively formed at the ends thereof with projecting pieces 60. The outer peripheral surfaces of the projecting pieces 60 are formed to have substantially equal curvature to that of the sleeve member 42. It is preferable that the longitudinal length $\phi_1$ of the entire bulb support 50 is smaller than the inner diameter $\phi_2$ of the sleeve member 42 so that the entire support 50 may move in the sleeve member 42. Preferably, $\phi_2-\phi_1$ is preferably equal to 0.6 mm or less.

In the embodiment described above, the pinch-seal portion 10*a* of the bulb 10 is constructed so as to hold the bulb 10 in a sandwiched state by the pinch-seal portion 10*a* by contacting the side walls of the supporting portions 52 with the opposite side surfaces of the pinch-seal portion 10*a*, and the opposite side walls of the supporting portions 52 are then spot welded at both ends 84 thereof and fastened. The spherical surface 13 of the pinch-seal portion 10*a* is snugly contacted within the recess 80 formed on the side walls of the supporting portions 52, and the horizontal projecting portion 15 is engaged with the groove 82. In this manner, the bulb 10 is tightly fastened to the support 50. Then, the support 50 in which the bulb 10 is fastened is disposed in the sleeve member 42 press-fitted to the upper opening of the holder 16, the lead wires 61 of the filaments are welded to the corresponding support 62, and the support 50 is freely moved in the gap of $\phi_2-\phi_1$, thereby adjusting the position of the filaments. Subsequently, the projecting pieces 60 are fastened to the sleeve member 42 by plasma welding.

Figure 9:
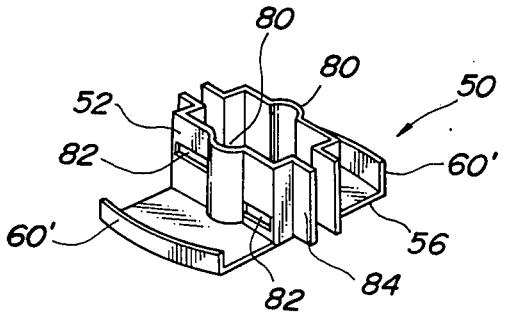
FIG. 9 is an enlarged perspective view showing still another example of the bulb support.

FIG. 9 shows a modified example of the bulb support 50. The projecting pieces 60' of a base are respectively formed at a pair of strip flanges extended along the inner surface of a sleeve member 42. The strip flanges 60' are respectively disposed oppositely at the opposite portions of the inside surfaces of the cylindrical sleeve member 42. After the bulb 10 is mounted on the supporting portion 52, the flanges 60' are welded at several positions by plasma welding to the inner wall of the sleeve member 42.

According to the present invention as described above, the halogen lamp device for the headlamp is constructed to have the rigid mounting structure of the halogen lamp to the holder, to readily dispose the filaments at the suitable position in the reflector enclosure, and to eliminate the variation in the relative position between the filaments and the holder by the application of the external force to the bulb.

What is claimed is:

1. A halogen lamp device for a headlamp having an airtightly sealed lamp enclosure including a light beam passing lens, a reflector for guiding the light beam and a socket opening provided in the reflector, and a holder made of synthetic resin in which a halogen bulb having filaments inserted through the socket opening of the lamp enclosure and sealed is mounted, comprising:

a metallic sleeve member engaged with said holder, and a metallic bulb support formed to have a supporting portion for fixedly supporting the halogen bulb in engagement with the outer peripheral surface of a pinch-seal portion of said halogen bulb and a flange including at least one projection wall integrally formed with the supporting portion and extended in parallel along the inner wall of said sleeve member, said sleeve member and said bulb support being constructed to move relative to each other, said halogen bulb being adjusted by said relative movement so that said bulb is disposed at a predetermined position in said enclosure, the projecting wall of said support being welded to said sleeve member after said adjustment.

2. The halogen lamp device as claimed in claim 1, wherein said bulb support is formed to have a pair of supporting portions for sandwiching the outer peripheral surface of the pinch-seal portion of said bulb from both opposite sides, and flanges respectively extended from the lower ends of said supporting portions, the supporting portions being welded to each other.

3. The halogen lamp device as claimed in claim 2, wherein the projecting walls of said flanges are respectively formed at the opposite positions of said pinch-seal portion.

4. The halogen lamp device as claimed in claim 2, wherein the projecting walls of said flanges are formed in strip shape along the inner wall of said sleeve member.

5. A halogen lamp device for a headlamp having an airtightly sealed lamp enclosure including a light beam passing lens, a reflector for guiding the light beam and a socket opening provided in the reflector, and a holder made of synthetic resin in which a halogen bulb having filaments inserted through the socket opening of the lamp enclosure and sealed is mounted, comprising:

a metallic sleeve member engaged with said holder, and a metallic bulb support formed to have a supporting portion for supporting the halogen bulb in engagement with the outer peripheral surface of a pinch-seal portion of said halogen bulb and a base including a flange fastened to said sleeve member, said bulb support including:

means for adjusting said halogen bulb at a predetermined position in said lamp enclosure, said bulb support being fastened to said sleeve member after adjustment of said bulb; and means for adjusting said halogen bulb by movement of said supporting portion relative to said base, said supporting portion being fastened to said base after adjustment of said bulb by movement of said supporting portion.

6. The halogen lamp device as claimed in claim 5, wherein an anchoring piece is formed by cutting to contact with the outer peripheral surface of the pinch-seal portion of said bulb on the supporting portion of said bulb support.

7. The halogen lamp device as claimed in claim 6, wherein the anchoring piece of said supporting portion is formed downwardly obliquely in the inside to contact with the opposite sides of the outer peripheral surface of said pinch-seal portion.

* * * * *